US007404771B2

(12) United States Patent
Kumamoto

(10) Patent No.: US 7,404,771 B2
(45) Date of Patent: Jul. 29, 2008

(54) GOLF CLUB SHAFT

(75) Inventor: Tomio Kumamoto, Hyogo (JP)

(73) Assignee: SRI Sports Limited, Kobe-Shi (JP)

( * ) Notice: Subject to any disclaimer, the term of this patent is extended or adjusted under 35 U.S.C. 154(b) by 0 days.

(21) Appl. No.: 11/214,837

(22) Filed: Aug. 31, 2005

(65) Prior Publication Data

US 2006/0058111 A1 Mar. 16, 2006

(30) Foreign Application Priority Data

Sep. 14, 2004 (JP) ..... 2004-267079

(51) Int. Cl.
*A63B 53/10* (2006.01)

(52) U.S. Cl. ..... 473/319

(58) Field of Classification Search ..... 473/319
See application file for complete search history.

(56) References Cited

U.S. PATENT DOCUMENTS 5,314,180 A * 5/1994 Yamagishi et al. ..... 473/521
5,437,450 A * 8/1995 Akatsuka et al. ..... 473/320
6,273,830 B1 * 8/2001 Takemura et al. ..... 473/319
2001/0007836 A1 * 7/2001 Atsumi et al. ..... 473/319

FOREIGN PATENT DOCUMENTS

JP 11-309226 A 11/1999

* cited by examiner

*Primary Examiner*—Stephen Blau
(74) *Attorney, Agent, or Firm*—Birch, Stewart, Stewart & Birch, LLP

(57) ABSTRACT

A golf club shaft composed of a laminate of a plurality of carbon fiber reinforced prepreg sheets having a length equal to the full length of the golf club shaft and are sequentially wound round a mandrel. Per-area weights of the carbon fibers of the carbon fiber prepreg sheets having the length equal to the full length of the golf club shaft are gradually increased from an innermost-layer CF prepreg sheet to an outermost-layer carbon fiber prepreg sheet in such a way that the per-area weight of the outermost-layer carbon fiber prepreg sheet is set larger than that of the innermost-layer CF prepreg sheet.

6 Claims, 5 Drawing Sheets

[Prior Art]

GOLF CLUB SHAFT

This Nonprovisional application claims priority under 35 U.S.C. § 119(a) on Patent Application No(s). 2004-267079 filed in Japan on Sep. 14, 2004, the entire contents of which are hereby incorporated by reference.

FIELD OF THE INVENTION

The present invention relates to a golf club shaft and more particularly to a golf club shaft that is lightweight and has a high strength.

DESCRIPTION OF THE RELATED ART

In recent years, to allow a golf ball hit with a golf club shaft (hereinafter often referred to as merely shaft) to improve speed and stability in hitting the golf ball therewith, the present tendency is to make weight concentrate on the golf club head as well as making the golf club shaft as lightweight as possible. Therefore the material of the golf club shaft is moving from steal popularly used to fiber reinforced resin such as carbon prepreg which is lightweight and has a proper degree of flexibility.

But to make the shaft lightweight will cause it to have a low strength. There is a fear that the shaft composed of a laminate of fiber reinforced resin sheets is broken owing to an interlaminar separation and is not as resistant as the conventional steal shaft to an impact and hence have an interlaminar separation or is broken.

To overcome the above-described problem, there is proposed a golf club shaft as disclosed in Japanese Patent Application Laid-Open No. 11-309226 (patent document 1). As shown in FIG. 6, to enhance the strength of the shaft, the inner fiber reinforced prepreg composing the adjusting layer 2 has a higher specific gravity and a lower elasticity than the fiber reinforced prepreg composing the body layer 1, having layers 1*a* and 1*b*, that is disposed outward from the adjusting layer 2.

Although the specific gravity and the elasticity of a part of the laminate are specifically set, the above-described construction improves the strength of the shaft to a low extent and does not provide the shaft with a sufficient effect in improving the torsional breaking strength thereof.

SUMMARY OF THE INVENTION

The present invention has been made in view of the above-described problems. Therefore it is an object of the present invention to provide a golf club shaft that is lightweight and has a high bending strength and torsional breaking strength.

To achieve the object, according to the present invention, there is provided a golf club shaft having a plurality of resin sheets, reinforced with carbon fibers, which have a length equal to a full length of the golf club shaft and are sequentially wound round a mandrel. The resin sheets reinforced with the carbon fibers are composed of carbon fiber prepreg sheets formed by impregnating the carbon fibers arranged properly in one direction with a resin. Per-area weights of the carbon fibers of the carbon fiber prepreg sheets having the length equal to the full length of the golf club shaft are gradually increased from an innermost-layer carbon fiber prepreg sheet to an outermost-layer carbon fiber prepreg sheet by setting the per-area weight of the carbon fiber of the carbon fiber prepreg sheet to not less than that of the adjacent inner-layer carbon fiber prepreg sheet in such a way that the per-area weight of the carbon fiber of the outermost-layer carbon fiber prepreg sheet is set larger than that of the innermost-layer carbon fiber prepreg sheet.

Because the carbon fiber (hereinafter often referred to as CF) is strong, inexpensive, and has a wide variety, the carbon fiber is most favorably used as the reinforcing fiber for the shaft composed of the laminate of prepreg sheets formed by impregnating reinforcing fibers arranged properly in one direction with the matrix resin. Therefore the carbon fiber is used as the reinforcing fiber of the shaft of the present invention composed of the laminate of the prepreg sheets, it is possible to compose the laminate of the prepreg sheets containing other reinforcing fibers partly.

The weight of the golf club shaft is set in consideration of the weight of the entire golf club and a weight balance thereof. Further there is a growing demand for the development of a lightweight golf club shaft. It is preferable to reduce the number of layers of the prepreg sheets to maintain a set weight of the shaft and enhance the strength thereof. In the process of layering the prepreg sheets one upon another, a vacant space may be generated between layers or adjacent layers may be dislocated from each other, which may cause an interlaminar separation and reduction in the strength of the shaft. By reducing the number of layers, the number of intervals therebetween decreases. Thereby it is possible to correct the cause of the occurrence of the above-described problems. Consequently it is possible to manufacture the shaft of the present invention having a sufficient strength reliably and reduce the cost for manufacturing it.

To maintain the degree of rigidity required for the golf club shaft and reduce the number of layers, the per-area weight of the carbon fiber of the prepreg sheet should be increased. The radius of curvature of the inner-layer prepreg sheet is small. Thus when the per-area weight of the carbon fiber of the inner-layer prepreg sheet is increased, the inner-layer prepreg sheet wrinkles in the process of winding the prepreg sheets round a mandrel. Consequently the strength of the shaft deteriorates.

On the other hand, when the per-area weight of the carbon fiber of the outermost-layer prepreg sheet is increased, an external impact applied to the outermost layer is transmitted to the inner layer adjacent thereto. Thus an impact force applied to the inner layer is allowed to be lower than that applied to the inner layer when the outermost layer has less per-area weight of the carbon fiber. Therefore it is possible to increase the resistance to shock of the golf club shaft effectively by increasing the per-area weight of the carbon fiber of the outer-layer prepreg sheet.

For the above-described reason, in the present invention, the carbon fiber of the inner-layer prepreg sheet has a smaller weight per area, whereas the carbon fiber of the outer-layer prepreg sheet has a larger weight per area. Thereby the golf club shaft of the present invention has a sufficient strength without increasing the weight of the golf club shaft.

It is preferable that the carbon fibers of the carbon fiber prepreg sheets are arranged properly in one direction. It is also preferable that the per-area weight of the carbon fiber of each of the carbon fiber prepreg sheets having a length equal to the full length of the golf club shaft is set to not less than 20 g/m$^2$ nor more than 300 g/m$^2$ and that a thickness of each of the carbon fiber prepreg sheets is not less than 0.03 mm nor more than 0.30 mm.

The reason the per-area weight of the carbon fiber of each of the carbon fiber prepreg sheets is set to not less than 20 g/m$^2$ nor more than 300 g/m$^2$ is as follows: If the per-area weight of the carbon fiber of each prepreg sheet is less than 20 g/m$^2$, even the innermost layer is incapable of realizing a predetermined torque value and torque breaking strength. When the number of turns of CF prepreg sheets is increased so that the predetermined torque value and torque breaking strength are obtained, the number of intervals between adjacent layers increases. Thereby an interlaminar separation is liable to occur. On the other hand, if the per-area weight of the carbon fiber of each prepreg sheet is more than 300 g/m$^2$, the weight of the shaft increases, which is contrary to the intention of the present invention of making the shaft lightweight.

The reason the thickness of each carbon fiber prepreg sheet is set to not less than 0.03 mm nor more than 0.30 mm is as follows: If the thickness of each carbon fiber prepreg sheet is set to less than 0.03 mm, it is necessary to increase the number of turns of prepreg sheets so that the predetermined torque value and flex value of the shaft are realized. Consequently the number of intervals between layers increases, which causes an interlaminar separation to occur and the strength of the shaft to decrease. On the other hand, when the thickness of each carbon fiber prepreg sheet is set to more than 0.30 mm, the content of the resin increases. Thereby destruction occurs initially in the resin, which leads to deterioration of the strength of the shaft.

More specifically, it is favorable that the per-area weight of the carbon fiber (CF1) of the innermost-layer CF prepreg sheet having a length equal to the full length of the golf club shaft is set to not less than 20 g/m$^2$ nor more than 125 g/m$^2$; the per-area weight of the carbon fiber (CFn) of the outermost-layer CF prepreg sheet is set to not less than 125 g/m$^2$ nor more than 300 g/m$^2$; and an average per-area weight of the carbon fibers (CFm) of the intermediate-layer carbon fiber prepreg sheets disposed between the innermost-layer carbon fiber prepreg sheet and the outermost-layer carbon fiber prepreg sheet is set to not less than 125 g/m$^2$ nor more than 225 g/m$^2$.

The reason the per-area weight of the carbon fiber (CF1) of the innermost-layer CF prepreg sheet is set to not less than 20 g/m$^2$ nor more than 125 g/m$^2$ is as follows: When the pre-area weight of the carbon fiber (CF1) of the innermost-layer CF prepreg sheet is less than 20 g/m$^2$, the shaft has an insufficient degree of strength. On the other hand, when the pre-area weight of the carbon fiber of the innermost-layer CF prepreg sheet is more than 125 g/m$^2$, the amount of the fiber is so large that it is difficult to wind the prepreg sheets round the surface of the mandrel. Consequently the innermost-layer CF prepreg sheet is liable to wrinkle. It is more favorable that the per-area weight of the carbon fiber of the innermost-layer CF prepreg sheet is set to not less than 25 g/m$^2$ nor more than 10 g/m$^2$. It is most favorable that the per-area weight of the carbon fiber of the innermost-layer CF prepreg sheet is set to 50 g/m$^2$.

The reason the per-area weight of the carbon fiber (CFn) of the outermost-layer CF prepreg sheet is set to not less than 125 g/m$^2$ nor more than 300 g/m$^2$ is as follows: When the pre-area weight of the carbon fiber of the outermost-layer CF prepreg sheet is set to less than 125 g/m$^2$, the content of the fiber is small. Thus when the number of layers is increased to realize a predetermined diameter of the shaft, the interlaminar separation is liable to occur. On the other hand, when the pre-area weight of the carbon fiber of the outermost-layer CF prepreg sheet is more than 300 g/m$^2$, it is difficult to realize the predetermined diameter of the shaft. This is because it is difficult to wind the mandrel with integral turns of the innermost-layer CF prepreg sheet. When the mandrel is not wound with integral turns of the innermost-layer CF prepreg sheet, the shaft has a low strength owing to a variation in the strength thereof. Even if the mandrel can be wound with integral turns of the outermost-layer CF prepreg sheet, there is a big difference in level between the winding start portion of the outermost-layer CF prepreg sheet and the winding finish portion thereof that overlaps the winding start portion. Thereby the portion having a big difference in level is liable to be broken. It is more favorable that the per-area weight of the carbon fiber of the outermost-layer CF prepreg sheet is set to not less than 150 g/m$^2$ nor more than 275 g/m$^2$. It is most favorable that the per-area weight of the carbon fiber of the outermost-layer CF prepreg sheet is set to not less than 175 g/m$^2$ nor more than 250 g/m$^2$.

The reason the average per-area weight of the carbon fibers (CFm) of the intermediate-layer carbon fiber prepreg sheets is set to not less than 125 g/m nor more than 225 g/m$^2$ is as follows: When the average per-area weight of the carbon fibers (CFm) of the intermediate-layer carbon fiber prepreg sheets is set to less than 125 g/m$^2$, there is a possibility that the per-area weight of the intermediate-layer carbon fiber prepreg sheets is smaller than that of the innermost-layer CF prepreg sheet. In this case, in destruction caused by a high degree of torque and a high degree of twist, a stress concentrates on the innermost-layer CF prepreg sheet. To obtain the predetermined diameter of the shaft, it is necessary to increase the number of layers, namely, the number of opening gaps between adjacent layers. Consequently the interlaminar separation is liable to occur. When the average per-area weight of the carbon fibers (CFm) of the intermediate-layer CF prepreg sheets is set to more than 225 g/m$^2$, there is a possibility that the per-area weight of the intermediate-layer CF prepreg sheets is larger than that of the outermost-layer CF prepreg sheet. In this case, in destruction caused by a high degree of torque and bending, a stress concentrates on the outermost-layer CF prepreg sheet. Consequently the outermost-layer CF prepreg sheet is liable to be broken. It is more favorable that the average per-area weight of the carbon fibers of the intermediate-layer CF prepreg sheets is set to not less than 130 g/m$^2$ nor more than 200 g/m$^2$.

Favorably, supposing that a number of the carbon fiber prepreg sheets each having a length equal to the full length of the golf club shaft is N, (CFn/CF1)/N is set to a range of 0.3 to 2.5; and CFm/(CF1+CFn) is set to a range of 0.3 to 0.6.

The reason (CFn/CF1)/N is set to the range of 0.3 to 2.5 is as follows: If (CFn/CF1)/N is less than 0.3, there is little variation in the per-area weights of the CF of the CF prepreg sheets. Thus it is necessary to increase the number of layers so that the per-area weight of each of the carbon fiber (CF1) of the innermost-layer CF prepreg sheet and that of the carbon fiber (CFn) of the outermost-layer CF prepreg sheet is set to a predetermined value. Consequently the strength of the shaft is liable to decrease owing to the occurrence of the interlaminar separation. On the other hand, if (CFn/CF1)/N is more than 2.5, the per-area weight of the CF of the carbon fiber (CFn) of the outermost-layer CF prepreg sheet is so large that there is a big difference in level between the winding start portion of the outermost layer and the winding finish portion thereof that overlaps the winding start portion. Thus the shaft is liable to be broken. It is more favorable that (CFn/CF1)/N is not less than 0.4 nor more than 2.3.

The reason CFm/(CF1+CFn) is set to not less than 0.3 nor more than 0.6 is as follows: If CFm/(CF1+CFn) is less than 0.3, a stress is apt to concentrate between the outermost-layer CF prepreg sheet and the intermediate-layer CF prepreg sheet. On the other hand, if CFm/(CF1+CFn) is more than 0.6, a stress is apt to concentrate between the innermost-layer CF prepreg sheet and the intermediate-layer CF prepreg sheet. In both cases, the strength of the shaft deteriorates. It is more favorable that CFm/(CF1+CFn) is not less than 0.4 nor more than 0.7.

It is favorable that the total number of the CF prepreg sheets having the length equal to the full length of the shaft is not less than three nor more than 11. If the total number of the CF prepreg sheets is less than three, it is necessary to design the bending rigidity and the torsional rigidity of the shaft in a very narrow range. On the other hand, if the total number of the CF prepreg sheets is more than 12 or more, it is necessary to increase the number of layers, namely, the number of opening gaps between adjacent layers. Consequently the strength of the shaft is liable to be broken owing to the occurrence of the interlaminar separation. It is more favorable that the total number of the CF prepreg sheets is not less than four nor more than 10.

It is preferable that the innermost-layer CF prepreg sheet having a length equal to the full length of the golf club shaft is formed as a bias layer. The bias layer is more suitable than a straight layer in being wound round the surface of the mandrel having a small curvature. Thereby the innermost-layer CF prepreg sheet does not wrinkle and hence destruction of the shaft can be prevented.

When the shaft has a weight in a range of 35 g to 60 g and a length in a range of 889 mm to 1219 mm, it can be preferably used.

The reason the shaft has a weight in the range of 35 g to 60 g is as follows: If the weight of the shaft is less than 35 g, the strength of the shaft deteriorates outstandingly. Thus even the above-described construction is incapable of preventing the deterioration of the strength of the shaft. On the other hand, if the weight of the shaft is more than 60 g, the shaft is so heavy that its operability deteriorates. The weight of the shaft is more favorably not less than 38 g nor more than 58 g.

The reason the shaft has a length 889 mm to 1219 mm is as follows: If the length of the shaft is less than 889 mm, the shaft has a favorable operability, but is incapable of hitting a golf ball a long distance. On the other hand, if the length of the shaft is more than 1219 mm, a golfer has difficulty in swinging the shaft. The length of the shaft is more favorably not less than 902 mm nor more than 1206mm.

As described above, unlike the innermost CF prepreg sheet of the conventional shaft that is liable to wrinkle, the innermost CF prepreg sheet of the shaft of the present invention can be wound easily along the surface of the mandrel without wrinkling it. Therefore it is possible to prevent wrinkle-caused breakage of the shaft. The per-area weights of the carbon fibers of the CF prepreg sheets are gradually increased from the innermost-layer CF prepreg sheet to the outermost-layer carbon fiber prepreg sheet by setting the per-area weight of the carbon fiber of the CF prepreg sheet to not less than that of the adjacent inner-layer CF prepreg sheet. Therefore it is possible to prevent a stress from concentrating on the innermost-layer carbon fiber prepreg sheet and other portions and increase the resistance of the shaft to an external shock applied thereto. Further it is possible to prevent an increase in the number of opening gaps between adjacent layers and prevent interlaminar separation-caused breakage of the shaft.

DETAILED DESCRIPTION OF THE PREFERRED EMBODIMENTS

The embodiments of the present invention will be described below with reference to the drawings.

Figure 1:
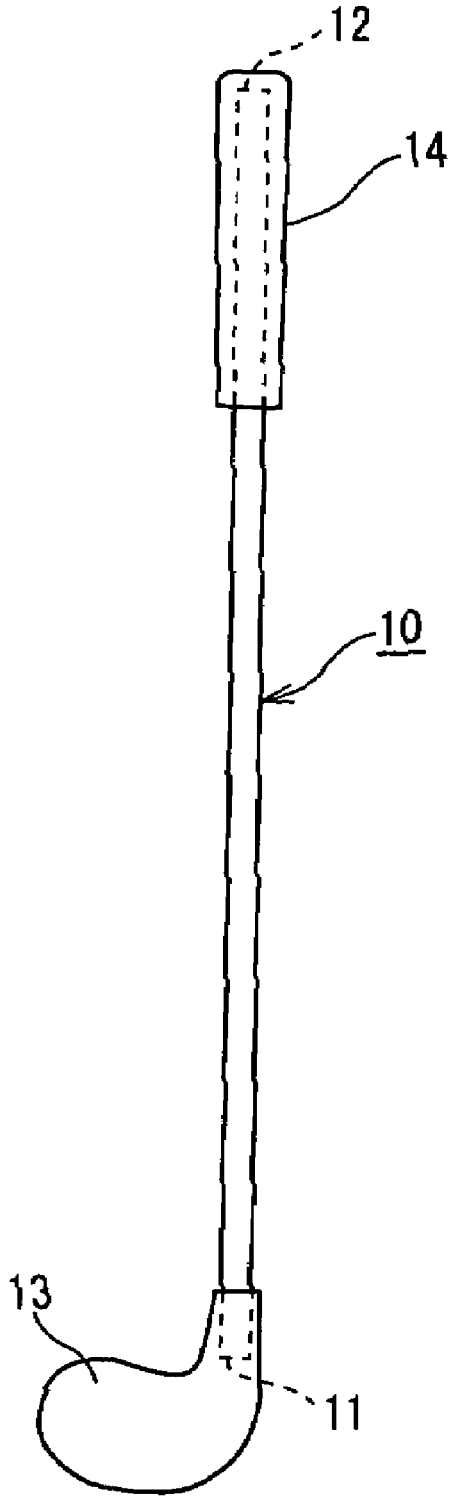
FIG. 1 is a schematic view showing a golf club shaft according to a first embodiment of the present invention.
Figure 2:
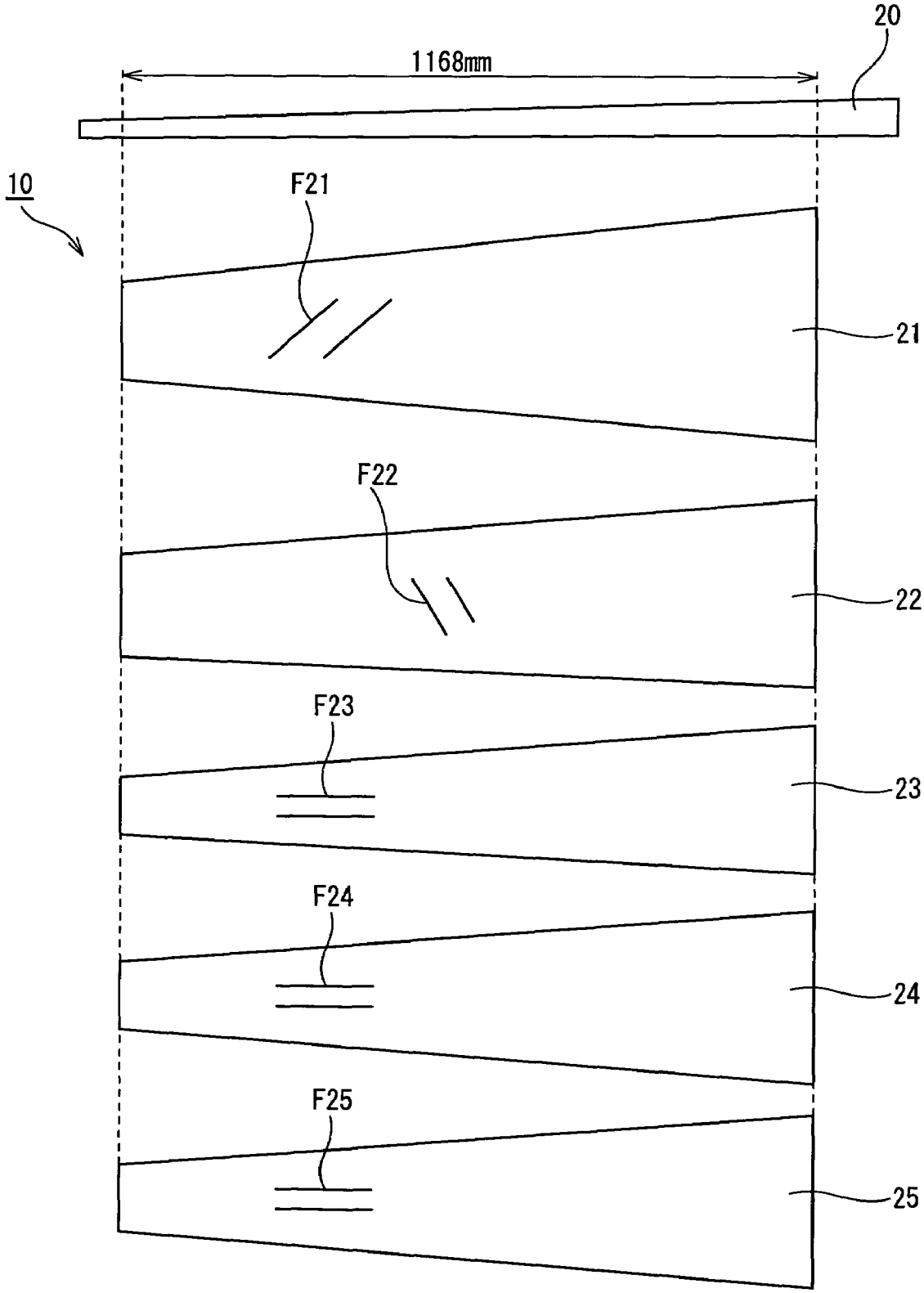
FIG. 2 shows a layering structure of carbon fiber prepregs sheets of the golf club shaft shown in FIG. 1.

FIGS. 1 and 2 show a golf club shaft (hereinafter referred to as merely shaft) 10 according to a first embodiment of the present invention. The shaft 10 consists of a tapered hollow member composed of a laminate of prepreg sheets 21 through 25 reinforced with carbon fibers (hereinafter often referred to as CF prepreg sheets). A head 13 is mounted on the shaft 10 at a head-side end 11 thereof having a smaller diameter. A grip 14 is mounted on the shaft 10 at a grip-side end 12 thereof having a larger diameter.

The whole length of the shaft 10 is set to 889 mm to 1219 mm. In the first embodiment, the whole length of the shaft 10 is set to 1168 mm. The weight thereof is set to 35 g to 60 g. In the first embodiment, the weight thereof is set to 50 g.

The shaft 10 is manufactured as follows: CF prepreg sheets 21 through 25, impregnated with resin, which have carbon fibers arranged properly in one direction are sequentially wound round a mandrel 20 and layered one upon another by using a sheet winding method, as shown in FIG. 2. Thereafter a tape (not shown) made of polypropylene is wound round the laminate of the CF prepreg sheets 21 through 25. Integral molding is performed by heating the laminate wound with the tape in an oven under pressure to harden the resin. Thereafter the mandrel 20 is drawn out of the laminate to manufacture the shaft 10. After the surface of the shaft 10 is polished, both ends thereof are cut. Then the shaft 10 is painted.

The length of each of the CF prepreg sheets 21 through 25 composing the shaft 10 is equal to the full length of the shaft 10. In each of the CF prepreg sheets 21 through 25, carbon fibers F21, F22, F23, F24, and F25 are impregnated with epoxy resin. Thermosetting resin other than the epoxy resin may be used.

More specifically, the innermost-layer CF prepreg sheet 21 has a width to such an extent that the mandrel is wound with two turns thereof. The innermost-layer CF prepreg sheet 21 has 0.05 mm in its thickness and 50 g/m$^2$ in the per-area weight of the carbon fiber (CF1) thereof. The carbon fiber F21 has a fibrous angle of 45° with respect to the axis of the shaft 10.

The width of the second-layer CF prepreg sheet 22 has a width to such an extent that the mandrel is wound with two turns thereof. The second-layer CF prepreg sheet 22 has 0.084 mm in its thickness and 100 g/m$^2$ in the per-area weight of the carbon fiber thereof. The carbon fiber F22 has a fibrous angle of −45° with respect to the axis of the shaft 10.

The width of the third-layer CF prepreg sheet 23 has a width to such an extent that the mandrel is wound with one turn thereof. The third-layer CF prepreg sheet 23 has 0.105 mm in its thickness and 125 g/m$^2$ in the per-area weight of the carbon fiber thereof. The carbon fiber F23 has a fibrous angle of 0° with respect to the axis of the shaft 10.

The width of the fourth-layer CF prepreg sheet 24 has a width to such an extent that the mandrel is wound with one turn thereof. The fourth-layer CF prepreg sheet 24 has 0.147 mm in its thickness and 175 g/m$^2$ in the per-area weight of the carbon fiber thereof. The carbon fiber F24 has a fibrous angle of 0° with respect to the axis of the shaft 10.

The width of the outermost-layer CF prepreg sheet 25 has a width to such an extent that the mandrel is wound with one turn thereof. The outermost-layer CF prepreg sheet 25 has 0.21 mm in its thickness and 250 g/m$^2$ in the per-area weight of the carbon fiber (CFn) thereof. The carbon fiber F25 has a fibrous angle of 0° with respect to the axis of the shaft 10.

In the golf club shaft 10 having the above-described construction, the per-area weight of the carbon fiber (CF1) of the innermost-layer CF prepreg sheet 21 is set to the minimum, whereas the per-area weight of the carbon fiber (CFn) of the outermost-layer CF prepreg sheet 25 is set to the maximum.

Because the CF prepreg sheet 21, having the smallest curvature, which is wound around the mandrel 20 has the smallest amount of fiber, the CF prepreg sheet 21 can be wound easily along the surface of the mandrel 20. Further because the CF prepreg sheet 21 is a bias layer, it can be wound easily round the mandrel 20 without wrinkling it. Therefore it is possible to prevent wrinkle-caused breakage of the shaft 10.

The outermost-layer CF prepreg sheet 25 most susceptible to an external shock has the largest amount of fiber. Thus the outermost-layer CF prepreg sheet 25 is resistant to the shock, thus enhancing the strength of the shaft 10. Further the per-area weight of the carbon fiber of the CF prepreg sheet increases gradually in the order from the innermost-layer CF prepreg sheet 21 to the outermost-layer CF prepreg sheet 25. Thereby it is possible to prevent the shaft from being broken because a stress does not concentrate on the gap between adjacent layers. In addition, it is possible to prevent an increase of the number of layers in realizing a required diameter of the shaft. Thereby it is possible to reduce the degree of occurrence of an interlaminar separation.

The value of (CFn/CF1)/n is 1. Because the rate of change of the per-area weight of the carbon fiber is proper, it is unnecessary to use a large number of layers and possible to reduce the difference in level between the winding start portion of the outermost layer and the winding finish portion thereof. CFm, namely, the average per-area weight of carbon fibers of intermediate-layer prepreg sheets is 133 g/m$^2$. Thus CFm/(CFn+CF1) is about 0.4. Therefore it is possible not to make a too big difference between the per-area weight of the CF of the intermediate layers and that of the CF of the innermost layer as well as that of the outermost layer. Therefore it is possible to prevent a stress from concentrating on the innermost-layer CF prepreg sheet 21 and the outermost-layer CF prepreg sheet 25.

Further because the thickness of the CF prepreg sheets 21 through 25 is not less than 0.03 mm nor more than 0.3 mm, it is possible to realize a required torque value and a flex value of the shaft without increasing the number of layers.

Figure 3:
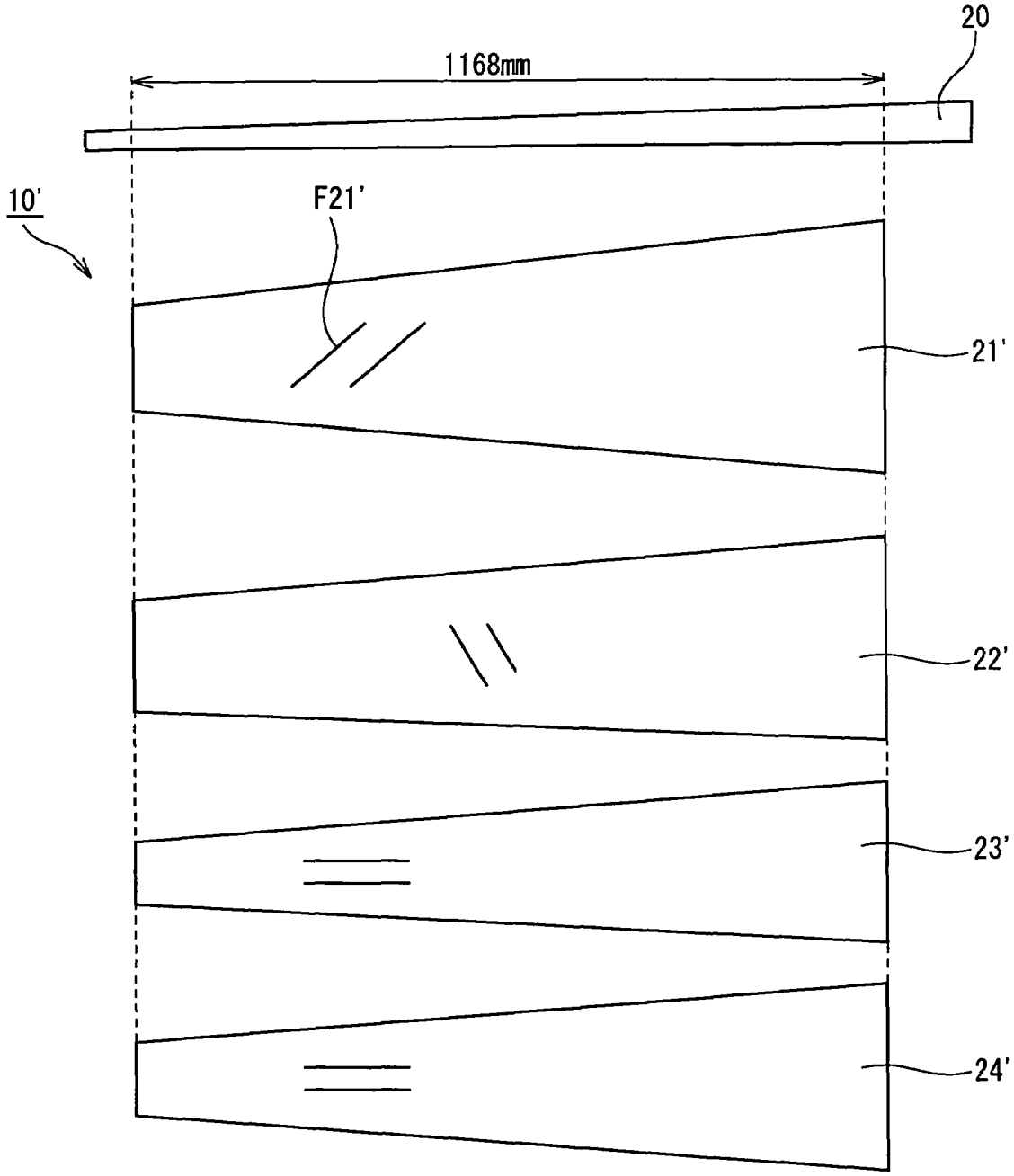
FIG. 3 shows a layering structure of carbon fiber prepregs sheets of a golf club shaft according to a second embodiment of the present invention.

FIG. 3 shows the layered construction of the golf club shaft (hereinafter referred to as merely shaft) 10' according to the second embodiment of the present invention. The shaft 10' is composed of a laminate of CF prepreg sheets 21' through 24' wound round a mandrel 20. The second embodiment is characterized in that the per-area weight of the third-layer CF prepreg sheet 23' and that of the outermost-layer CF prepreg sheet 24' are set equally to each other.

More specifically, the innermost-layer CF prepreg sheet 21' has a width to such an extent that the mandrel is wound with two turns thereof. The innermost-layer CF prepreg sheet 21' has 0.05 mm in its thickness and 50 g/m$^2$ in the per-area weight of the carbon fiber (CF1) thereof. A carbon fiber F21' has a fibrous angle of 45° with respect to the axis of the shaft 10'.

The second-layer CF prepreg sheet 22' has a width to such an extent that the mandrel is wound with two turns thereof. The second-layer CF prepreg sheet 22' has 0.126 mm in its thickness and 150 g/m$^2$ in the per-area weight of the carbon fiber thereof. A carbon fiber F22' has a fibrous angle of −45° with respect to the axis of the shaft 10'.

The third-layer CF prepreg sheet 23' has a width to such an extent that the mandrel is wound with one turn thereof. The third-layer CF prepreg sheet 23' has 0.21 mm in its thickness and 250 g/m$^2$ in the per-area weight of the carbon fiber thereof. A carbon fiber F23' has a fibrous angle of 0° with respect to the axis of the shaft 10'.

The outermost-layer CF prepreg sheet 24' has a width to such an extent that the mandrel is wound with one turn thereof, similarly to the third-layer CF prepreg sheet 23'. The outermost-layer CF prepreg sheet 24' has 0.21 mm in its thickness and 250 g/m$^2$ in the per-area weight of the carbon fiber (CFn) thereof. A carbon fiber F24' has a fibrous angle of 0° with respect to the axis of the shaft 10'.

The per-area weight of the carbon fiber of the CF prepreg sheet is not increased gradually in the order from the innermost-layer CF prepreg sheet to the outermost-layer CF prepreg sheet. But similarly to the first embodiment, the per-area weight of the carbon fiber of the CF prepreg sheet is not decreased gradually in the order from the innermost-layer CF prepreg sheet 21' to the outermost-layer CF prepreg sheet 24'. In the second embodiment, the per-area weight of the carbon fiber of the innermost-layer CF prepreg sheet 21' is set to the minimum, whereas the per-area weight of the carbon fiber of the outermost-layer CF prepreg sheet 24' is set to the maximum. Therefore it is possible to prevent wrinkling of the innermost layer, concentration of a stress on particular regions, and further secure the strength of the outermost layer.

The value of (CFn/CF1)/n is 1.25. Because the rate of change of the per-area weight of the carbon fiber is proper, it is unnecessary to use a large number of layers. The per-area weight of carbon fibers (CFm) of intermediate-layer prepreg sheets is 200 g/m$^2$. Thus CFm/(CFn+CF1) is about 0.7. Therefore it is possible not to make a too big difference between the per-area weight of the carbon fiber the intermediate layers and that of the carbon fiber of the innermost-layer prepreg sheet as well as the outermost-layer prepreg sheet. Thereby it is possible to prevent a stress from concentrating on the innermost-layer CF prepreg sheet 21' and the outermost-layer CF prepreg sheet 24'.

The present invention is not limited to the above-described embodiments. For example, the number of the CF prepreg sheets may be three or not less than six. The adjacent layers having an equal amount of the per-area weight of the carbon fiber do not necessarily have to be disposed in the outer layers, but may be disposed in the intermediate layers thereof, the inner layers thereof or at a plurality of positions of the outer, intermediate, and inner layers. The shaft does not necessarily have to be composed of the CF prepreg sheets, but may be composed of prepreg sheets containing other reinforcing fibers in addition to the CF prepreg sheets. In addition to the CF prepreg sheets having a length equal to the full length of the shaft, a prepreg sheet which is used at a portion of the shaft may be used.

EXAMPLES

To confirm the above description, the golf club shafts of examples 1 through 4 of the present invention and comparison examples 1 through 4 will be described in detail below. The effect of the present invention is clarified in the examples. But the present invention should not be limitedly interpreted based on the description of the examples.

As shown in table 1, in the golf club shafts of the examples 1 through 4 and the comparison examples 1 through 4, carbon fibers of CF prepreg sheets composing the innermost layer through the outermost layer had different per-area weights and thicknesses.

The three-point bending strength and the torsional breaking strength of each shaft were measured. Table 1 shows the results.

TABLE 1

| | CE1 | CE2 | CE3 | CE4 | E1 | E2 | E3 | E4 |
|---|---|---|---|---|---|---|---|---|
| Per-area weight of CF (carbon fiber) of innermost-layer CF prepreg sheet | 250 | 50 | 200 | 100 | 50 | 50 | 50 | 50 |
| Per-area weight of CF (carbon fiber) of second-layer CF prepreg sheet | 175 | 175 | 200 | 150 | 100 | 150 | 150 | 100 |
| Per-area weight of CF (carbon fiber) of third-layer CF prepreg sheet | 125 | 175 | 150 | 150 | 125 | 250 | 150 | 150 |
| Per-area weight of CF (carbon fiber) of fourth-layer CF prepreg sheet | 100 | 150 | 100 | 150 | 175 | 250 | 175 | 200 |
| Per-area weight of CF (carbon fiber) of fifth-layer CF prepreg sheet | 50 | 100 | 50 | 150 | 250 | | 175 | 200 |
| Per-area weight of CF (carbon fiber) of sixth-layer CF prepreg sheet | | 50 | | 50 | | | | |
| Thickness of innermost-layer CF prepreg sheet | 0.21 | 0.05 | 0.168 | 0.084 | 0.05 | 0.05 | 0.05 | 0.05 |
| Thickness of second-layer CF prepreg sheet | 0.147 | 0.147 | 0.168 | 0.126 | 0.084 | 0.126 | 0.126 | 0.084 |
| Thickness of third-layer CF prepreg sheet | 0.105 | 0.147 | 0.126 | 0.126 | 0.105 | 0.21 | 0.126 | 0.126 |
| Thickness of fourth-layer CF prepreg sheet | 0.084 | 0.124 | 0.084 | 0.126 | 0.147 | 0.21 | 0.147 | 0.168 |
| Thickness of fifth-layer CF prepreg sheet | 0.05 | 0.084 | 0.05 | 0.126 | 0.21 | | 0.147 | 0.168 |
| Thickness of sixth-layer CF prepreg sheet | | 0.05 | | 0.05 | | | | |
| SG type three-point bending strength Strength (kgf) at point T | 150 | 145 | 150 | 160 | 220 | 230 | 225 | 220 |
| SG type torsional breaking strength (N · m) | 1600 | 1850 | 1700 | 1800 | 2150 | 2500 | 2100 | 2105 |

where E denotes example and where CE denotes comparison example.

The shaft of each of the examples and the comparison examples were formed by the sheet winding method. The same method as that used in the first embodiment was used to form the shafts. All of the shafts of the examples 1 through 4 and the comparison examples 1 through 4 were made of CF prepreg sheets composed of the reinforcing carbon fibers impregnated with epoxy resin. The mandrel was wound with four turns of an innermost-layer CF prepreg sheet having a length equal to the full length of the shaft as a bias layer forming an angle of 45° with respect to the axis of the shaft. CF prepreg sheets constituting other layers each having the length equal to the full length of the shaft were sequentially layered as a straight layer respectively forming an angle of 0° with respect to the axis of the shaft. The mandrel was wound with one turn of each of these layers. Each of the shafts had a length of 1168 mm.

Example 1

The layered construction of CF prepreg sheets was the same as that of the CF prepreg sheets of the first embodiment. The per-area weight of the CF (CF1) of each CF prepreg sheet and the thickness thereof were equal to those of the CF prepreg sheets of the first embodiment. More specifically, the shaft was composed of five CF prepreg sheets. The innermost-layer CF prepreg sheet had 50 g/m$^2$ in the per-area weight of the carbon fiber thereof and 0.05 mm in its thickness. The second-layer CF prepreg sheet had 100 g/m$^2$ in the per-area weight of the carbon fiber thereof and 0.084 mm in its thickness. The third-layer CF prepreg sheet had 125 g/m$^2$ in the per-area weight of the carbon fiber thereof and 0.105 mm in its thickness. The fourth-layer CF prepreg sheet had 175 g/m$^2$ in the per-area weight of the carbon fiber thereof and 0.147 mm in its thickness. The outermost layer (fifth-layer) CF prepreg sheet had 250 g/m$^2$ in the per-area weight of the carbon fiber (CFn) thereof and 0.21 mm in its thickness. That is, in the example 1, the value of (CFn/CF1)/n was set to 1. The value of CFm/(CF1+CFn) was set to about 0.4.

"MR350C" produced by Mitsubishi Rayon Inc. and "MR40" produced by Mitsubishi Rayon Inc. were used as the resin and the reinforcing fiber respectively for both the innermost-layer and second-layer CF prepreg sheets. "350C" produced by Mitsubishi Rayon Inc. and "TR50S" produced by Mitsubishi Rayon Inc. were used as the resin and the reinforcing fiber respectively for the third-layer through outermost-layer CF prepreg sheets.

Example 2

The layered construction of the CF prepreg sheets was the same as that of the CF prepreg sheets of the second embodiment. The per-area weight of the CF of each CF prepreg sheet and the thickness thereof were equal to those of the CF prepreg sheets of the second embodiment. More specifically, the shaft was composed of four CF prepreg sheets. The innermost-layer CF prepreg sheet had 50 g/m$^2$ in the per-area weight of the carbon fiber (CF1) thereof and 0.05 mm in its thickness. The second-layer CF prepreg sheet had 150 g/m$^2$ in the per-area weight of the carbon fiber thereof and 0.126 mm in its thickness. Each of the third-layer and the outermost-layer (fourth layer) CF prepreg sheets had 250 g/m$^2$ in the per-area weight of the carbon fiber (CFn) thereof and 0.21 mm in the thickness thereof. That is, in the example 2, the value of (CFn/CF1)/n was set to 1.25. The value of CFm/(CF1+CFn) was set to about 0.7.

"MR350C" produced by Mitsubishi Rayon Inc. and "MR40" produced by Mitsubishi Rayon Inc. were used as the resin and the reinforcing fiber respectively for the innermost-layer and second-layer CF prepreg sheets. "350C" produced by Mitsubishi Rayon Inc. and "TR50S" produced by Mitsubishi Rayon Inc. were used as the resin and the reinforcing fiber respectively for the third-layer and fourth-layer CF prepreg sheets.

Example 3

The per-area weight of the CF of the second-layer CF prepreg sheet and that of the third-layer CF prepreg sheet were set equally. The per-area weight of the CF of the fourth-layer CF prepreg sheet and that of the fifth-layer CF prepreg sheet were also set equally. The variation of the per-area weight of the CF from the innermost-layer prepreg sheet to the outermost-layer prepreg sheet was set smaller than that of the per-area weight of the CF of the example 1. More specifically, the shaft was composed of five CF prepreg sheets. The innermost-layer CF prepreg sheet had 50 g/m$^2$ in the per-area weight of the carbon fiber (CF1) thereof and 0.05 mm in its thickness. Each of the second-layer and third-layer CF prepreg sheets had 150 g/m$^2$ in the per-area weight of the carbon fiber thereof and 0.126 nm in the thickness thereof. Each of the fourth-layer and outermost-layer CF prepreg sheets (fifth layer) had 175 g/m$^2$ in the per-area weight of the carbon fiber (CFn) thereof and 0.147 mm in the thickness thereof. That is, in the example 3, the value of (CFn/CF1)/n was set to 0.7. The value of CFm/(CF1+CFn) was set to about 0.7. In other constructions, the example 3 was the same as the example 1.

Example 4

The per-area weight of the CF of the fourth-layer CF prepreg sheet and that of the fifth-layer CF prepreg sheet were set equally. The variation of the per-area weight of the CF from the innermost-layer CF prepreg sheet to the outermost-layer CF prepreg sheet was set smaller than that of the per-area weight of the CF of the example 1. More specifically, the shaft was composed of five CF prepreg sheets. The innermost-layer CF prepreg sheet had 50 g/m$^2$ in the per-area weight of the carbon fiber (CF1) thereof and 0.05 mm in its thickness. The second-layer CF prepreg sheet had 100 g/m$^2$ in the per-area weight of the carbon fiber thereof and 0.084 mm in the thickness thereof. The third-layer CF prepreg sheet had 150 g/m$^2$ in the per-area weight of the carbon fiber thereof and 0.126 mm in the thickness thereof. Each of the fourth-layer and outermost-layer (fifth layer) CF prepreg sheets had 200 g/m$^2$ in the per-area weight of the carbon fiber (CFn) thereof and 0.168 nm in the thickness thereof. That is, in the example 4, the value of (CFn/CF1)/n was set to 0.8. The value of CFm/(CF1+CFn) was set to about 0.6. In other constructions, the example 4 was the same as the example 1.

Comparison Example 1

The per-area weight of the CF was decreased gradually from the innermost-layer prepreg sheet to the outermost-layer prepreg sheet. More specifically, the shaft was composed of five CF prepreg sheets. The innermost-layer CF prepreg sheet had 250 g/m$^2$ in the per-area weight of the carbon fiber (CF1) thereof and 0.21 mm in its thickness. The second-layer CF prepreg sheet had 175 g/m$^2$ in the per-area weight of the carbon fiber thereof and 0.147 mm in the thickness thereof. The third-layer CF prepreg sheet had 125 g/m$^2$ in the per-area weight of the carbon fiber thereof and 0.105 mm in the thickness thereof. The fourth-layer CF prepreg sheet had 100 g/m$^2$ in the per-area weight of the carbon fiber thereof and 0.084 mm in the thickness thereof. The outermost layer (fifth layer) had 50 g/m$^2$ in the per-area weight of the carbon fiber (CFn) thereof and 0.05 mm in the thickness thereof. That is, in the comparison example 1, the value of (CFn/CF1)/n was set to 0.04. The value of CFm/(CF1+CFn) was set to about 0.4. In other constructions, the comparison example 1 was the same as the example 1.

Comparison Example 2

The per-area weight of the CF was maximum at the intermediate-layer CF prepreg sheet and decreased gradually from the intermediate-layer CF prepreg sheet to the outermost-layer prepreg sheet. More specifically, the shaft was composed of six CF prepreg sheets. The innermost-layer CF prepreg sheet had 50 g/m$^2$ in the weight of the carbon fiber (CF1) thereof and 0.05 mm in its thickness. Each of the second-layer and third-layer CF prepreg sheets had 175 g/m$^2$ in the per-area weight of the carbon fiber thereof and 0.147 mm in the thickness thereof. The fourth-layer CF prepreg sheet had 150 g/m$^2$ in the per-area weight of the carbon fiber thereof and 0.124 mm in the thickness thereof. The fifth-layer CF prepreg sheet had 100 g/m$^2$ in the per-area weight of the carbon fiber thereof and 0.084 mm in the thickness thereof. The outermost layer (sixth layer) had 50 g/m$^2$ in the per-area weight of the carbon fiber (CFn) thereof and 0.05 mm in the thickness thereof. That is, in the comparison example 2, the value of (CFn/CF1)/n was set to 0.16. The value of CFm/(CF1+CFn) was set to 1.5.

"MR350C" produced by Mitsubishi Rayon Inc. and "MR40" produced by Mitsubishi Rayon Inc. were used as the resin and the reinforcing fiber respectively for both the innermost-layer and second-layer CF prepreg sheets. "350C" produced by Mitsubishi Rayon Inc. and "TR50S" produced by Mitsubishi Rayon Inc. were used as the resin and the reinforcing fiber respectively for the third-layer through fifth-layer CF prepreg sheets.

The per-area weight of the CF of the innermost-layer CF prepreg sheet and that of the second-layer CF prepreg sheet were set equally. The per-area weight of the CF was decreased gradually from the second-layer CF prepreg sheet to the outermost-layer prepreg sheet. More specifically, the shaft was composed of five CF prepreg sheets. Each of the innermost-layer and second-layer CF prepreg sheets had 200 g/m$^2$ in the weight of the carbon fiber (CF1) thereof and 0.168 mm in its thickness. The third-layer CF prepreg sheets had 150 g/m$^2$ in the per-area weight of the carbon fiber thereof and 0.126 mm in the thickness thereof. The fourth-layer CF prepreg sheet had 100 g/m in the per-area weight of the carbon fiber thereof and 0.084 mm in the thickness thereof. The outermost-layer (fifth-layer) CF prepreg sheet had 50 g/m$^2$ in the per-area weight of the carbon fiber (CFn) thereof and 0.05 mm in the thickness thereof. That is, in the comparison example 3, the value of (CFn/CF1)/n was set to 0.05. The value of CFm/(CF1+CFn) was set to 0.6. In other constructions, the comparison example 3 was the same as the example 1.

Comparison Example 4

The per-area weight of the CF was maximum at the intermediate-layer CF prepreg sheet and was minimum at the outermost-layer CF prepreg sheet. The variation of the per-area weight of the CF was set small. More specifically, the shaft was composed of six CF prepreg sheets. The innermost-layer prepreg sheet had 100 g/m$^2$ in the weight of the carbon fiber (CF1) thereof and 0.84 mm in its thickness. The second-layer through fifth-layer CF prepreg sheets had 150 g/m$^2$ in the weight (CF1) of the carbon fiber thereof and 0.126 mm in its thickness. The outermost layer (sixth-layer) CF prepreg sheet had 50 g/m$^2$ in the per-area weight of the carbon fiber (CFn) thereof and 0.05 mm in the thickness thereof. That is, in the comparison example 4, the value of (CFn/CF1)/n was set to about 0.08. The value of CFm/(CF1+CFn) was set to one.

"MR350C" produced by Mitsubishi Rayon Inc. and "MR40" produced by Mitsubishi Rayon Inc. were used as the resin and the reinforcing fiber respectively for the innermost-layer CF prepreg sheet. "350C" produced by Mitsubishi Rayon Inc. and "TR50S" produced by Mitsubishi Rayon Inc. were used as the resin and the reinforcing fiber respectively for the second-layer through fifth-layer CF prepreg sheets.

Three-Point Bending Strength Test

Figure 4:
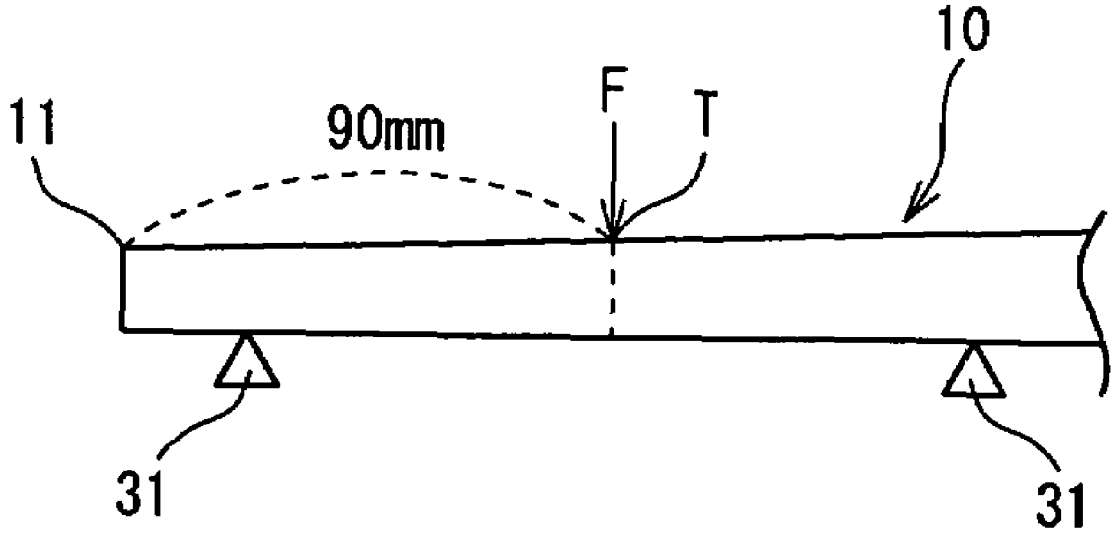
FIG. 4 shows a method of measuring a bending strength.

The three-point bending strength means a breaking strength provided by the Product Safety Association. As shown in FIG. 4, a load F is applied from above to a shaft 10 supported at three points. The value (peak value) of the load when the shaft 10 was broken was measured. The bending strength was measured at points spaced at intervals of 90 mm (point T), 175 mm (point A), and 525 mm (point B) from the tip 11 of the shaft 10, respectively and a point C spaced at an interval of 175 mm from the butt 12 of the shaft 10. The span between supporting points 31 was 150 mm when the bending strength was measured at the point T and 300 mm when the bending strength was measured at the points A, B, and C (FIG. 4 shows the case in which the bending strength was measured at the point A).

Measurement of Torsional Breaking Strength

Figure 5:
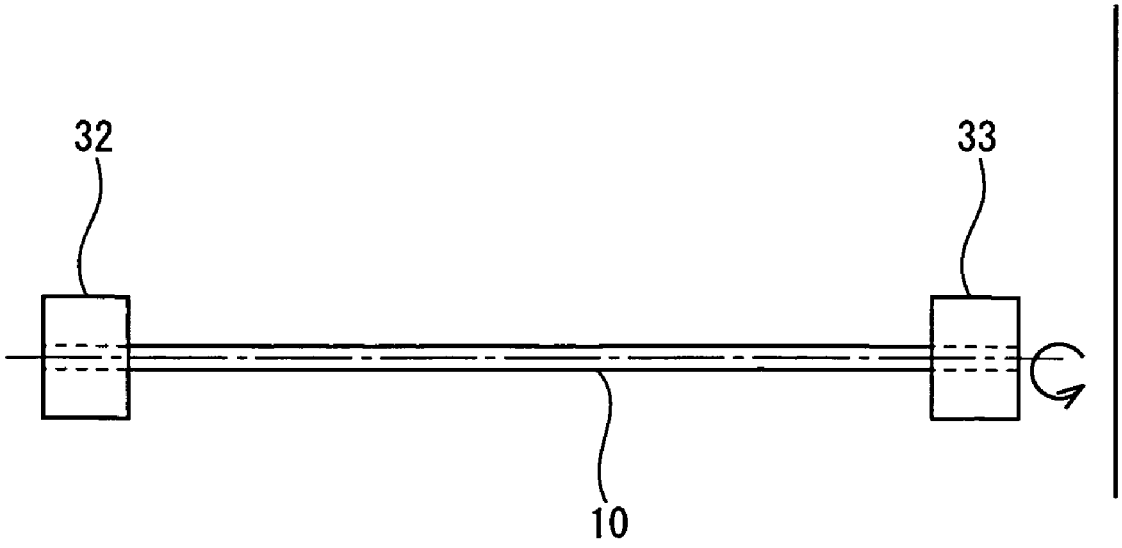
FIG. 5 shows a method of measuring a torsional breaking strength.
Figure 6:
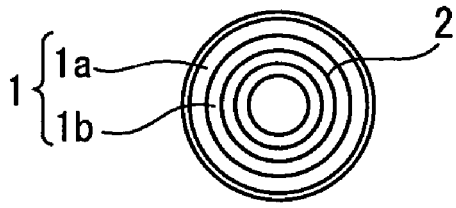
FIG. 6 shows a conventional art.

The torsional breaking strength is laid down by the product safety association. As shown in FIG. 5, both ends of the shaft 10 were fixed to jigs 32, 33. The jig 33 is rotated to twist the shaft 10, while the jig 32 is kept stationary. The product of a torque and an angle of twist when the shaft 10 was broken was computed.

As can be confirmed in table 1, the shafts of the examples 1 through 4 had higher bending strength and torsional breaking strength than the shafts of the comparison examples. This is because the innermost-layer CF prepreg sheet had the smallest CF per-area weight and hence could be wound round the mandrel without being wrinkled. In addition, the CF per-area weight was increased gradually from the innermost-layer CF prepreg sheet toward the outermost-layer CF prepreg sheet in such a way that the outermost-layer CF prepreg sheet had the maximum per-area weight of the CF. Hence the shaft had a high strength against an external shock applied thereto.

The shaft of the example 2 had a higher bending strength and torsional breaking strength than the shafts of the examples 1, 3, and 4. This is because a small number of prepreg sheets, namely, four prepreg sheets were used. Thus it was possible to prevent the generation of an interlaminar separation.

The shafts of the comparison examples 1 through 4 had lower bending strength and the torsional breaking strength than the shafts of the examples. This is because in the shaft of each of the comparison examples 1 through 4, the innermost-layer CF prepreg sheet or the intermediate-layer CF prepreg sheets had the largest per-area weight of the CF, and the outermost-layer CF prepreg sheet had the smallest per-area weight of the CF. The shafts of the comparison examples 1 and 3 were lower than those of the comparison examples 2 and 4 in the bending strength and the torsional breaking strength thereof. This is because in each of the shafts of the comparison examples 1 and 3, the innermost-layer CF prepreg sheet had the largest per-area weight of the CF and was thus thick. When the innermost-layer CF prepreg sheet has a large per-area weight of the CF and is thus thick, it cannot be wound easily along the surface of the mandrel and thus it is apt to be wrinkled and broken. In each of the shafts of the comparison examples 2 and 4, the outermost-layer CF prepreg sheet to which an external shock is applied to the highest extent had the smaller per-area weight of the CF than the other layers. Therefore the shock could not be dispersed to the inner-layer CF prepreg sheets.

What is claimed is:

1. A golf club shaft comprising a plurality of at least three resin sheets, reinforced with carbon fibers, which have a length equal to a full length of said golf club shaft and are sequentially wound around a mandrel, wherein said resin sheets reinforced with said carbon fibers are composed of carbon fiber prepreg sheets formed by impregnating said carbon fibers arranged properly in one direction with a resin;

wherein in all carbon fiber prepreg sheets which have a length equal to a full length of said golf club shaft, a per-area weight of said carbon fiber in each of said all carbon fiber prepreg sheets is more than a per-area weight of said carbon fiber in the adjacent inner layer carbon fiber prepreg sheet from an innermost-layer to an outermost layer; and wherein a per-area weight of said carbon fiber of said outermost-layer prepreg sheet is CFn, a per-area weight of the said carbon fiber of said innermost-layer prepreg sheet is CF1, and the number of said carbon fiber prepreg sheets each having a length equal to said full length of said golf club shaft is N, such that (CFn/CF1)/N is set to a range of 0.7 to 1.25.

2. The golf club shaft according to claim 1, wherein said carbon fiber prepreg sheets have a thickness not less than 0.03 mm nor more than 0.30 mm.

3. The golf club shaft according to claim 1, wherein said carbon fibers of said carbon fiber prepreg sheets are arranged properly in one direction; and said per-area weight of said carbon fiber of each of said carbon fiber prepreg sheets having said length equal to said full length of said golf club shaft is set to not less man 20 g/m$^2$ nor more than 300 g/m$^2$.

4. The golf club shaft according to claim 1, wherein said per-area weight of said carbon fiber (CF1) of said innermost-layer CF prepreg sheet having said length equal to said full length of said golf club shaft is set to not less than 20 g/m$^2$ nor more than 125 g/m$^2$; said per-area weight of said carbon fiber (CFn) of said outermost-layer CF prepreg sheet is set to not less than 125 g/m$^2$ nor more than 300 g/m$^2$; and an average per-area weight of said carbon fibers (CFm) of said intermediate-layer carbon fiber prepreg sheets disposed between said innermost-layer carbon fiber prepreg sheet and said outermost-layer carbon fiber prepreg sheet is set to not less than 125 g/m$^2$ nor more than 225 g/m$^2$.

5. The golf club shaft according to claim 1, wherein said innermost-layer CF prepreg sheet having said length equal to said full length of said golf club shaft is formed as a bias layer.

6. The golf club shaft according to claim 1, having a weight in a range of 35 g to 60 g and a length in a range of 889 mm to 1219 mm.

* * * * *